US007935907B2

(12) United States Patent
Espeseth et al.

(10) Patent No.: US 7,935,907 B2
(45) Date of Patent: May 3, 2011

(54) CONTACT SYSTEM FOR A SHORT-CIRCUITING DEVICE IN A MEDIUM-VOLTAGE OR HIGH-VOLTAGE SWITCHBOARD PLANT

(75) Inventors: Robert Espeseth, Skien (NO); Ole Granhaug, Skien (NO); Jan-Henrik Kuhlefelt, Skien (NO); Thor Endre, Skien (NO)

(73) Assignee: ABB Technology AG, Zurich (CH)

( * ) Notice: Subject to any disclaimer, the term of this patent is extended or adjusted under 35 U.S.C. 154(b) by 262 days.

(21) Appl. No.: 12/162,315

(22) PCT Filed: Jan. 24, 2007

(86) PCT No.: PCT/EP2007/000566

§ 371 (c)(1),
(2), (4) Date: Jul. 25, 2008

(87) PCT Pub. No.: WO2007/085425

PCT Pub. Date: Aug. 2, 2007

(65) Prior Publication Data

US 2009/0008229 A1 Jan. 8, 2009

(30) Foreign Application Priority Data

Jan. 25, 2006 (DE) ..... 10 2006 003 431
Jul. 21, 2006 (DE) ..... 10 2006 033 766

(51) Int. Cl.
*H01H 33/06* (2006.01)

(52) U.S. Cl. ..... 218/89; 200/506; 218/117

(58) Field of Classification Search ..... 200/506; 218/89, 147, 156, 158, 117
See application file for complete search history.

(56) References Cited

U.S. PATENT DOCUMENTS 3,213,251 A * 10/1965 Greber ..... 218/89
3,932,717 A * 1/1976 Dike et al. ..... 200/61.08
4,491,707 A * 1/1985 O'Leary ..... 218/89
4,659,887 A * 4/1987 Belbel et al. ..... 218/117
4,685,021 A 8/1987 Kortschinski et al.
4,700,030 A * 10/1987 Belbel et al. ..... 218/117
4,849,591 A * 7/1989 Comtois et al. ..... 218/117

(Continued)

FOREIGN PATENT DOCUMENTS

DE 3131417 2/1983

(Continued)

OTHER PUBLICATIONS

Mueller O et al: "Ein Kurzschliesser Fuer Hochspannungs-Schaltanlagen Mit Feststoffantrieb" Elektrie, Veb Verlag Technik., Berlin, DD, vol. 47, No. 3, Jan. 1993, pp. 105, 106, 111-11, XP000359817 ISSN: 0013-5933, figure 6.

*Primary Examiner* — Michael A Friedhofer
(74) *Attorney, Agent, or Firm* — Leydig, Voit & Mayer, Ltd.

(57) ABSTRACT

A contact system for a short-circuiting device for a switchboard, the contact system including at least one fixed contact piece connected to a main voltage source. The contact system also includes at least one moving contact piece and an insulating screen penetrable using the at least one moving contact piece so as to make contact between the at least one moving contact piece and the at least one fixed contact piece. The screen is disposed between the at least one fixed contact piece and the at least one moving contact piece.

18 Claims, 2 Drawing Sheets

U.S. PATENT DOCUMENTS

| | | | | |
|---|---|---|---|---|
| 5,761,025 | A * | 6/1998 | Iversen | 361/617 |
| 7,138,597 | B2 * | 11/2006 | Shea et al. | 218/7 |
| 7,397,012 | B2 * | 7/2008 | Stepniak et al. | 218/155 |
| 2003/0231438 | A1 | 12/2003 | Slade et al. | |
| 2004/0121639 | A1 | 6/2004 | Yaworski et al. | |

FOREIGN PATENT DOCUMENTS

| | | |
|---|---|---|
| DE | 3606770 | 9/1987 |
| DE | 3709684 | 10/1987 |
| DE | 4302416 | 8/1993 |
| DE | 19916327 | 10/2000 |

* cited by examiner

CONTACT SYSTEM FOR A SHORT-CIRCUITING DEVICE IN A MEDIUM-VOLTAGE OR HIGH-VOLTAGE SWITCHBOARD PLANT

CROSS REFERENCE TO PRIOR APPLICATIONS

This application is a U.S. National Phase application under 35 U.S.C. §371 of International Application No. PCT/EP2007/000566, filed on Jan. 24, 2007 and claims benefit to German Patent Application No. DE 10 2006 003 431.7, filed on Jan. 25, 2006 and German Patent Application No. DE 10 2006 033 766.2, filed on Jul. 21, 2006. The International Application was published in German on Aug. 2, 2007 as WO 2007/085425 under PCT Article 21 (2).

BACKGROUND

The present invention relates to a contact system for a short-circuiting device for a switchboard.

Electrical switchboards for voltages in the range from 1 to 52 kV, which range is generally described as the medium-voltage range, are designed in the form of metal-encapsulated gas-insulated switchboards, see DE 43 02 416, in which load isolating switches, grounding switches and fuses are accommodated as functional units.

When an arcing fault occurs in a switchboard of this kind, the effects of the arcing fault must be kept to a minimum. If the combustion time of such an arcing fault is appropriately long, the pressure and temperature within the switchboard can increase to such an extent that the metal encapsulation can burst or melt; in order that persons are not injured or even killed as a result of an uncontrolled outflow of heated gas into the room in which the switchboard is located, with many switchboards so-called designated breaking points are provided in the housing encapsulation through which, in the event of their breakage, the heated gas flows out in a controlled manner in a certain defined direction so that any operating personnel who may be in the room are not injured. A switchboard is described, see also DE 31 31 417, in which a short-circuiting device is provided, which on the occurrence of an arcing fault short circuits the phases or connects them to ground so that the short circuit is diverted as soon as it occurs and the effects of the arcing fault on the interior of the switchboard are limited. For this purpose, this switchboard has a pressure sensor, which by means of a storage spring gearbox brings moving switching contact pieces, which are designed in the form of contact blades, into contact with fixed contact pieces situated on the phase conductors, the drive being designed as a spring drive; the pressure sensor acts on a latching point, which releases the drive spring and thus drives the moving contact pieces into the fixed contact pieces at high speed, as a result of which the phases are short-circuited thus suppressing the arc.

With this switchboard, the fixed contact pieces are exposed within the switchboard so that certain distances have to be maintained between the fixed contact pieces and the grounded encapsulation.

As a basic principle, there is a requirement to make switchboards of this type as compact as possible, as the available space is limited and therefore expensive.

SUMMARY OF THE PRESENT INVENTION

An aspect of the present invention is to provide the fixed contact pieces of the contact system, which are at high voltage or medium voltage, in such a way that the distance between the contact pieces and the encapsulation or between the contact pieces themselves can be kept as small as possible.

Accordingly, the present invention provides at least one fixed contact piece being assigned a screen of insulating material, which can be penetrated by the moving contact piece to make contact with the fixed contact piece when the contact is switched on, the screen being arranged between the fixed and moving contact piece.

A particular advantage of the present invention includes a compact contact system for a switchboard being produced as a result of the embodiment according to the present invention so that overall the switchboard itself has a smaller space requirement.

At the same time, the arrangement of the screen of insulating material is chosen so that it is situated between the at least one fixed contact piece and the moving contact piece so that, when the moving contact piece approaches the at least one fixed contact piece, this does not give rise to a switch-on arc at an early stage.

According to an advantageous embodiment, the screen can be designed so that at least the part of the insulating material, which lies in the movement path of the moving contact piece, is soft so that the contact piece can penetrate the material. Of course, it is also possible for the insulating material to be hard, in which case it is important however that the thickness of the part, which lies in the movement path of the moving contact piece, is dimensioned in such a way that the moving contact piece can break through this section.

According to a further advantageous embodiment, the screen can also be formed by a hinged door or flap, which can be pushed open by the moving contact piece.

The moving contact piece may then be designed so that it can easily penetrate the insulating material. In a preferred manner, the moving contact piece can be designed so that it tapers towards its free end, wherein this taper can be in the form of a cone.

It is also possible that the tip, that is to say the free end, of the moving contact piece is rounded in a hemispherical manner. As used in the present invention, the term "hemispherical" is understood to mean "approximately hemispherical".

According to a particularly advantageous embodiment of the present invention, the at least one fixed contact piece can be surrounded by a tubular cylinder on which the penetrable or hinged insulating material is arranged.

If the fixed contact piece is mounted on one end of a rigid conductor or is formed by its face surface, the tubular cylinder can extend beyond the fixed contact piece and be closed by the penetrable insulating material at its free end.

In this case, the space inside the fixed tubular cylinder in which the fixed contact piece is located can be filled with insulating fluid, e.g. with liquid, in particular with insulating oil.

According to a particularly advantageous embodiment of the present invention, the insulating material assigned to the fixed contact piece can have an electrically conducting coating as an electrical screen and/or field control.

When the tubular cylinder is provided, the electrically conducting coating can be arranged inside the tubular cylinder.

Advantageous embodiments and improvements of the present invention can be seen in the further dependent claims.

BRIEF DESCRIPTION OF THE DRAWINGS

The present invention as well as further advantageous embodiments and improvements and further advantages of the present invention are explained and described in more detail with reference to the drawing, in which two exemplary embodiments of the present invention are shown.

In the drawings

DETAILED DESCRIPTION

Figure 1:
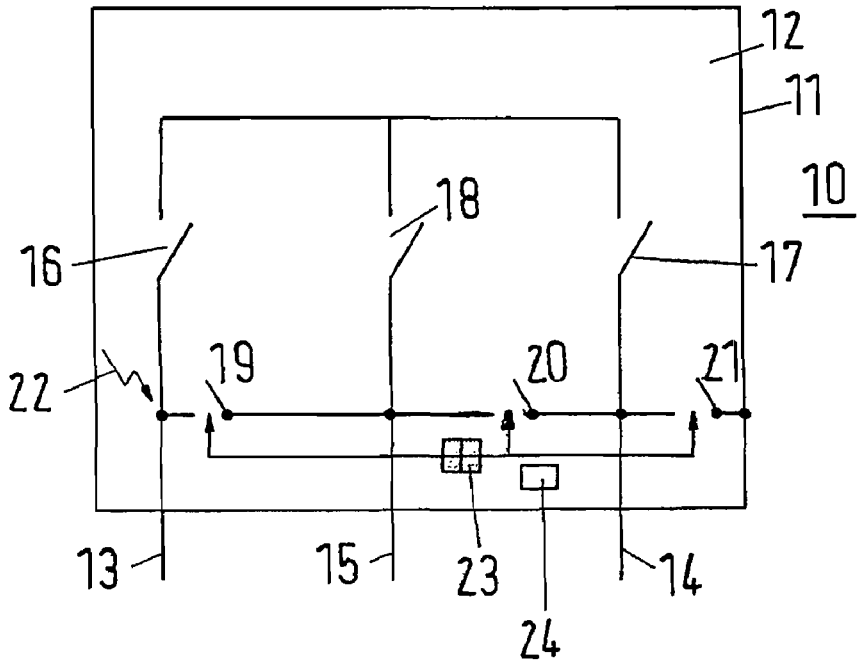
FIG. 1 shows a schematic representation of a switchboard in which the present invention is realized.

A switchboard 10 has a metal housing 11, which is shown only schematically, the interior 12 of which is filled with an insulating gas, for example with SF6 gas. Feed conductors 13 and 14 feed into the switchboard via suitable ducts, while an outgoing conductor 15 is arranged between the two feeds 13, 14. Load isolating switches 16, 17 and 18 are arranged in the feed and outgoing conductors 13 to 15. Furthermore, short-circuit switches 19, 20 and 21 are provided, which are actuated by a latching mechanism 23, the latching mechanism 23 having a latching point, which can be released by a sensor 24. In normal operation, the load isolating switches 16 and 18 may be closed; as a result, current flows into the switchboard via the feed conductor 13 and out of the switchboard via the outgoing conductor 15, for example to a transformer, which transforms the medium voltage into low voltage.

Naturally it is also possible that the switches 17, 18 are closed and the switch 16 is open. The current then flows into the switchboard and out of the switchboard via the feed conductor 14 and the outgoing conductor 15. Of course it is also possible that the conductors designated with 13 and 15 form the feed conductors and the conductor 14 the outgoing conductor from the switchboard; this depends on the external and internal circuit.

Such a circuit arrangement has also become known as a so-called Ring Main Unit, and is marketed by the company ABB AS, Division Kraftprodukter, Skien, Norway.

If an arcing fault 22 occurs in a switchboard of this kind, the temperature of the insulating gas within the switchboard 10 and therefore its pressure increase so that, unless suitable measures are taken, the switchboard can explode, on account of which the switchboard can have designated breaking points according to DE 36 06 770 for example, by means of which the hot gas can flow out in a systematic and controlled manner. With the system according to FIG. 1, which does not have a designated breaking point of this kind, the increase in pressure is detected by means of a pressure sensor 24, which releases the latching point in the latching mechanism 23 and thus closes the switches 19, 20 and 21, which are open in the normal state. This produces a short circuit between the individual phases by means of which the arc 22 is diverted; because of the short circuit produced in this way, a superimposed switch, for example a circuit breaker, trips.

In the case of the Ring Main Unit switchboard produced by the company ABB AS, Division Kraftprodukter, Skien, Norway, the individual switches 19, 20 and 21 are designed as blade contact switches; these blade contact switches engage in contact blade receptacles, as a result of which considerable space-saving is achieved.

A reduction in the space required is effected with the embodiments according to the present invention.

Connected to the feed and outgoing conductors 13, 14 and 15 is a rigid conductor 30, to the face side of which a fixed contact piece 31 in the shape of a tulip connector is fixed by means of a screw fastener 32. The rigid conductor 30 and the fixed contact piece 31 are surrounded by a cylindrical tube 33, which extends beyond the fixed contact piece 31 and is closed at its free end by means of a cap 34. The cylindrical tube is made of an insulating material, which if necessary can be coated on its outside with electrically conducting material in order to improve the field line characteristic.

Here, the sealing cap 34 is set into or let into a recess 35. In the embodiment according to FIG. 2 the cap 34 is made of silicone material; naturally it is also possible to make the cap from a rigid material.

It is naturally also possible to provide the coating with electrically conducting material on the inside of the cylindrical tube or tubular cylinder 33, wherein furthermore the coating also continues in the area of the recess 35.

Figure 2:
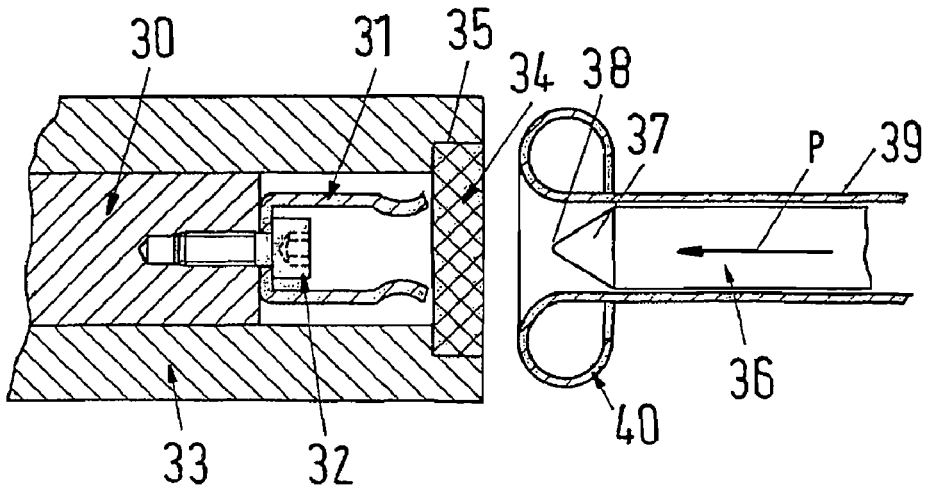
FIG. 2 shows a first embodiment of the present invention.

Assigned to the fixed contact piece 31 is a moving contact piece 36, which is pushed towards the fixed contact piece 31 in the direction of the arrow P when the contact switches on. In order that the moving contact piece 36 can penetrate the cap 34, the tip 37 of the moving contact piece 36 is designed in the form of a cone with a tip 38. In this case, the moving contact piece is connected to ground. It must be added that in each case there is a total of one contact point per phase as shown in FIG. 2 for each feed and outgoing conductor. By means of the moving contact piece 36 the individual phases can be connected to ground or a phase short circuit produced, which can likewise be interrupted by a superimposed circuit breaker.

To improve the electrical field, the moving contact piece is surrounded by a cylindrical tube 39 made from electrically conducting material in which the moving contact piece 36 slides; the end of the cylindrical tube 39 facing the fixed contact piece 31 has a peripheral bead 40 on the outside, by means of which the electrical field is uniformly distributed in the area of the contact point shown in FIG. 2.

The moving contact piece 36 can also execute a circular movement. For this purpose, an L-shaped arm 41 is fixed to a rotating shaft 42, which arm 41 merges into a moving contact piece 43, which corresponds to the moving contact piece 36. A field control arrangement such as that shown in FIG. 2 may also be used in this embodiment.

With the embodiment according to FIG. 2 a tulip connector 31 is fixed to the face of the contact piece 30; it is of course also possible to design the face of the rigid conductor in such a way that it forms a contact point with the moving contact piece, for example by making a cone-shaped depression in the face; in another embodiment the face could be flat and the tip of the moving contact piece hemispherical.

Figure 3:
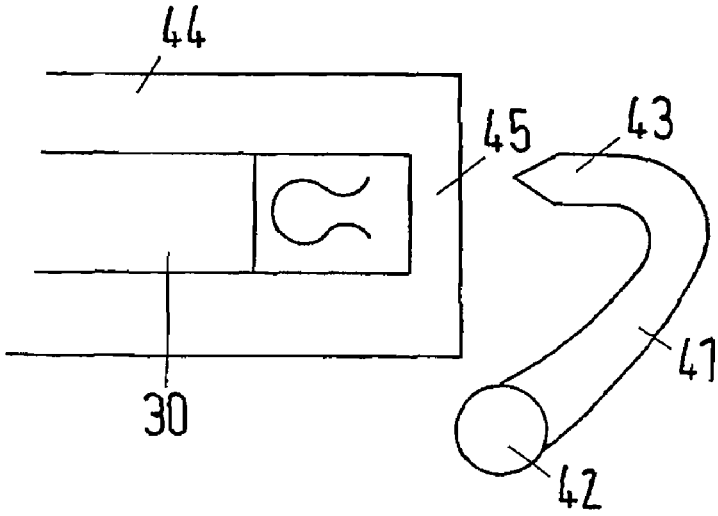
FIGS. 3 and 4 show two further embodiments of the present invention.

In the embodiment according to FIG. 3, the conductor 30 is enclosed by a cylindrical tube 44, which has a base 45, the thickness of which is dimensioned so that it can be easily penetrated by the moving contact piece 43, which naturally can also be the contact piece 36.

As an example, the cylindrical tube 33, 44 can be made of reusable thermoplastic polymer; the cap 34 can be made of a soft material such as silicone rubber for example, which allows the moving contact 36 to penetrate the cylindrical tube 33. The electrically conducting coating of the cylindrical tube is provided on the inside, particularly when the embodiments of the fixed contact piece are designed in a constructively simple manner.

The embodiment according to the present invention has been described with reference to an electrical switchboard; it is naturally also possible to install and use the present invention in other installation systems.

The inside of the cylinder 33 or 44 in which the tulip connector 31 is located can be filled with SF6 gas—like the environment—or with a liquid insulating material such as insulating oil or similar.

It is naturally also possible to use the present invention in such contact systems having two fixed contact pieces, which are bridged by one suitable moving contact piece to achieve a closure of the contact. In this respect the present invention is not limited to contact systems such as those described in FIG. 2 or FIG. 3.

Figure 4:
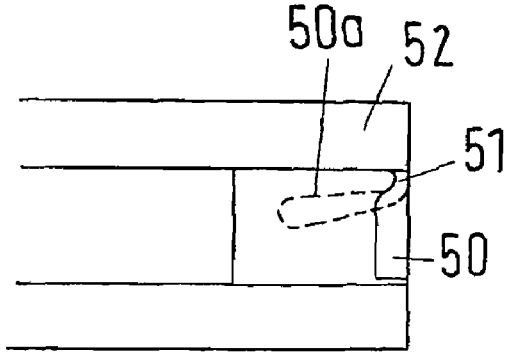

In the embodiment according to FIG. 4 the cap is designed in the form of a flap 50, which is made of deformable material, and is fixed to the cylindrical tube 52 by a kind of film hinge 51; in the event of a short circuit, the flap 50 is opened by the moving contact piece and swiveled into the position 50*a* shown dotted. Such an arrangement is useful, particularly when a tulip connector such as the tulip connector 31 is not provided. The flap can also be designed in the form of a sliding plate, which is actuated by the moving contact piece.

The term "insulating material", through which the moving contact piece passes, has the same meaning as the term "screen", as opposed to the term "electrical screen", which has the function of a field control.

What is claimed is:

1. A contact system for a short-circuiting device for a switchboard, the contact system comprising:

at least one fixed contact piece connected to a mains voltage source;

at least one moving contact piece connected to ground; and an insulating screen disposed between the at least one fixed contact piece and the at least one moving contact piece, wherein the at least one moving contact piece is configured to penetrate the insulation screen when an arcing fault is detected in the switchboard so as to make contact between the at least one moving contact piece and the at least one fixed contact piece and thereby short-circuit the mains voltage source.

2. The contact system as recited in claim 1, wherein the mains voltage source is a high voltage or medium voltage source.

3. The contact system as recited in claim 1, wherein the mains voltage source includes at least one phase, wherein the at least one fixed contact piece includes one fixed contact piece for each of the at least one phases.

4. The contact system as recited in claim 1, wherein at least a part of the screen includes a soft material penetrable by the at least one moving contact piece.

5. The contact system as recited in claim 1, wherein at least a part the screen includes a hard material having a thickness configured to be pierceable by the at least one moving contact piece.

6. The contact system as recited in claim 1, wherein at least a part of the screen includes a door or a flap configured to open when pushed by the at least one moving contact piece.

7. The contact system as recited in claim 1, wherein the at least one moving contact piece has a taper shape toward a free end.

8. The contact system as recited in claim 7, wherein the taper shape is a cone.

9. The contact system as recited in claim 1, wherein the at least one moving contact piece includes a tip having a rounded hemispherical shape.

10. The contact system as recited in claim 1, further comprising a tubular cylinder, wherein the at least one fixed contact piece is surrounded by the tubular cylinder, and wherein the screen is disposed on the tubular cylinder.

11. The contact system as recited in claim 10, further comprising a rigid conductor, wherein the at least one fixed contact piece is disposed on an end of the rigid conductor, wherein the tubular cylinder extends beyond the end of the rigid conductor and the at least one fixed contact piece and is configured to be closed by the screen on a free end.

12. The contact system as recited in claim 10, wherein the tubular cylinder includes an inside space filled with an insulating fluid.

13. The contact system as recited in claim 12, wherein the insulating fluid is a liquid.

14. The contact system as recited in claim 13, wherein the fluid is an insulating oil.

15. The contact system as recited in claim 1, wherein the screen includes an electrically conducting coating configured as an electrical screen or an electric field controller.

16. The contact system as recited in claim 15, further comprising a tubular cylinder, wherein the at least one fixed contact piece is surrounded by the tubular cylinder, and wherein the screen is disposed on the tubular cylinder, wherein the coating is disposed in at least one of an inside of the tubular cylinder and an outside of the tubular cylinder.

17. The contact system as recited in claim 1, wherein the at least one moving contact piece is disposed on a pivoted lever.

18. The contact system as recited in claim 1, wherein the at least one fixed contact piece includes three fixed contact pieces and the at least one moving contact piece includes three moving contact pieces respectively for the three fixed contact pieces, and wherein the mains voltage source includes three conductors, each conductor being connected to one of the three fixed contact pieces such that the three moving contact pieces respectively short-circuit individual phases of the mains voltage source at the detection of the arcing fault.

* * * * *